US005100011A

United States Patent [19]

Maietta

[11] Patent Number: 5,100,011

[45] Date of Patent: Mar. 31, 1992

[54] TAMPER EVIDENT CLOSURE

[75] Inventor: Michael G. Maietta, Cogan Station, Pa.

[73] Assignee: The West Company, Incorporated, Phoenixville, Pa.

[21] Appl. No.: 680,762

[22] Filed: Apr. 5, 1991

[51] Int. Cl.[5] ..... B65D 41/34

[52] U.S. Cl. ..... 215/256; 215/254; 215/253

[58] Field of Search ..... 215/256, 253, 254; 220/270, 276, 266; 222/568, 572

[56] References Cited

U.S. PATENT DOCUMENTS

| | | | |
|---|---|---|---|
| 3,650,428 | 3/1972 | Miller | 215/256 X |
| 3,837,518 | 9/1974 | Gach | 215/256 X |
| 3,955,716 | 5/1976 | Goncalves | 215/256 X |
| 4,402,415 | 9/1983 | Hopley | 215/256 X |
| 4,526,283 | 7/1985 | Skinner | 215/256 |
| 4,562,931 | 1/1986 | Brach et al. | 215/256 X |
| 4,760,941 | 8/1988 | Salmon et al. | 215/256 X |
| 4,805,807 | 2/1989 | Perne et al. | 215/256 X |
| 4,930,647 | 6/1990 | Dutt et al. | 215/256 X |

*Primary Examiner*—Gary E. Elkins
*Assistant Examiner*—Paul A. Schwarz
*Attorney, Agent, or Firm*—Eugene E. Renz, Jr.

[57] ABSTRACT

A combination of a cap and tube in which a tube has an opening terminating in a tapered nozzle with an open end. The nozzle has a first diameter proximate said tube and is designed for rotational engagement with a cap. The nozzle includes a ring with a diameter which is the largest diameter of the nozzle and is located at least a band width distance from the junction of the nozzle to the tube. The cap is sized to engage the nozzle at its open end and has a closed outer terminal end. The outer end of the cap includes an axially centered locating cup for engagement with the outer open end of the nozzle. This forms a first seal in a first position and a second seal in a second position which is closer to the outer cap end by the band width distance. The cap is designed for rotational engagement with the nozzle. At its nozzle engaging end, the cap terminates with a circumferential band having an axial width defining the above mentioned band width distance. The band has a frangible junction with the cap to permit removal therefrom. It also has a flange positioned to fit over the nozzle ring to fasten the cap to the nozzle. The cap can only be removed or moved to the second position when the band has been removed.

9 Claims, 3 Drawing Sheets 10
11
13
15
17
19
21
23
25
27
29
43
6
8
H

TAMPER EVIDENT CLOSURE

FIELD OF THE INVENTION

The present invention relates to tamper evident closure and more particularly to containers with caps or closures particularly adapted for use in packaging pharmaceutical products.

BACKGROUND OF THE INVENTION

Tamper evident container closures are not new per se. In almost any product which is intended to be consumed or otherwise in contact with humans, either internally or externally, there is a desire to package the product so that there is a visual indicia of the product having been opened. This will alert the user to possible tampering and/or opportunities for spoilage.

Plastic shrink wrapping of the closure and cap has not met with any significant success in the consumer market because of the difficulty in removing the seal as well as the need for removing bits and pieces of shrinkwrap plastic from the container. One particular class of goods which are particularly susceptible to tampering and/or spoilage when a seal is not complete are the containers in which a cap is attached to the nozzle of a container by a screw type cap.

A variety of prior art devices have been proposed which include the use of additional bands as part of the screw on cap, such that the removal of the cap will cause a tamper evident band to become detached from the cap but remain on the container. Typically, soft drinks are packaged in this manner. Accordingly, when it is desired to remove the cap, the user simply turns it in the direction to unscrew the cap and the tamper evident band is prevented from moving axially by reason of an interengaging rib, bead or flange. As torque is applied to the bridges connecting the tamper evident band to the skirt, fracture allowing the closure to separate from the band occurs and the closure is removed. The separated band demonstrates that the package has once been opened or possibly tampered with. When the cap is replaced, the tamper evident band is still on the container although it is no longer attached to the cap. The tamper evident band remains, being a detriment to appearance and aesthetics.

One method for maintaining tamper evident characteristics is disclosed in U.S. Pat. No. 4,848,615. In this patent, a fractural tear band is provided which can be removed once and which then identifies that the contents may have been exposed to access. This method, however, does away with the screw cap closure design and relies upon a cap which can be pried upwardly. This design is highly effective in providing tamper evidence, but again, does not effectively maintain the appearance of the container. In addition, there is no separate functional component or components which serve to protect the integrity of the seal, particularly when the container is used over a significant period of time. For example, toothpaste tubes and other similar products have a cap which is removed once or more every day over a relatively long period of time. It is desirable that the freshness of the contents be maintained by sealing the tube when the cap is on the tube. Nevertheless, there is a desire for a tamper evident feature, which, when it is removed, will not adversely affect the appearance and aesthetics of the tube.

Accordingly, it is an object of the present invention to provide a new and improved container assembly for a cap and tube device. It is another object of the present invention to provide a cap and tube device with a tamper evident feature which permits the maintenance of the appearance of the product after the tamper evident feature has been removed. Yet another object of the present invention is to provide an assembly which seals the cap and tube to protect the contents of the tube both before and after the tamper evident feature has been removed. Other objects will appear hereinafter.

SUMMARY OF THE INVENTION

It has now been discovered that the above and other objects of the present invention may be accomplished in the following manner. Specifically, a new and improved cap and tube device has been discovered.

The tube of the present invention has an opening which terminates in a tapered nozzle which also has an open end. The nozzle has a first diameter close to or proximate the junction with the tube and tapers toward the open end. The nozzle also has means for rotational engagement with a cap, such as screw threads. Located on the nozzle is a ring which has a diameter as large or larger than any diameter on the nozzle such as the first diameter. This ring is located a defined distance from the desired location of the open end of the cap on the nozzle. That distance is a band width defining distance.

A cap is also provided for engagement with the nozzle of the tube at the open end of the tube. The cap has a closed outer terminal end. The cap is formed from an annular disc or end, and had dependent skirts which form the side of the cap.

The cap end includes an axially centered locating cup on the inside surface of the cap end, which is provided for engagement with the outer open end of the nozzle. When first assembled, the locating cup and the open end of the nozzle form a first seal in a first position. The locating cup and nozzle end are also appropriately sized to permit the nozzle to move all the way to the outer terminal end of the cap to provide a second seal in a second position. The first position and second position are axially spaced from one another by the band width distance.

The cap has means for cooperating with the means for rotational engagement, such as screw threads formed on the inside of the cap. In a preferred embodiment, the cap threads are double threaded for maximum axial displacement per revolution of the cap.

The cap also terminates at its nozzle engaging open end with a circumferential band having an axial width which defines the band width distance. This circumferential band has a frangible junction to the cap to permit removal of the band. The band also includes a flange or protuberance which is positioned to fit over the nozzle ring to thereby fasten the cap to the nozzle.

The combination of the cap and tube device of the present invention is such that the band permits the cap to be removed or to be moved to the second position only when the band has been removed. In a preferred embodiment, the band includes a pull tab to facilitate removal, such as by pulling on the tab and rotating the band around the circumference of the cap as the band separates from the cap.

The preferred embodiment of the present invention includes a plurality of radially inwardly extending ratchet means mounted on the inside of the circumferential band. The nozzle includes ratchet engaging means for engaging the ratchet means on the band.

When the cap is rotated to place the cap on the nozzle, the ratchet and ratchet engaging means permit such rotation. However, the ratchet and ratchet engaging means prevent rotation of the cap in the reverse direction, thereby preventing removal of the cap. Only by removing the circumferential band first, can the cap be rotated off the nozzle.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figures 1, 2, 3, 4, 5:
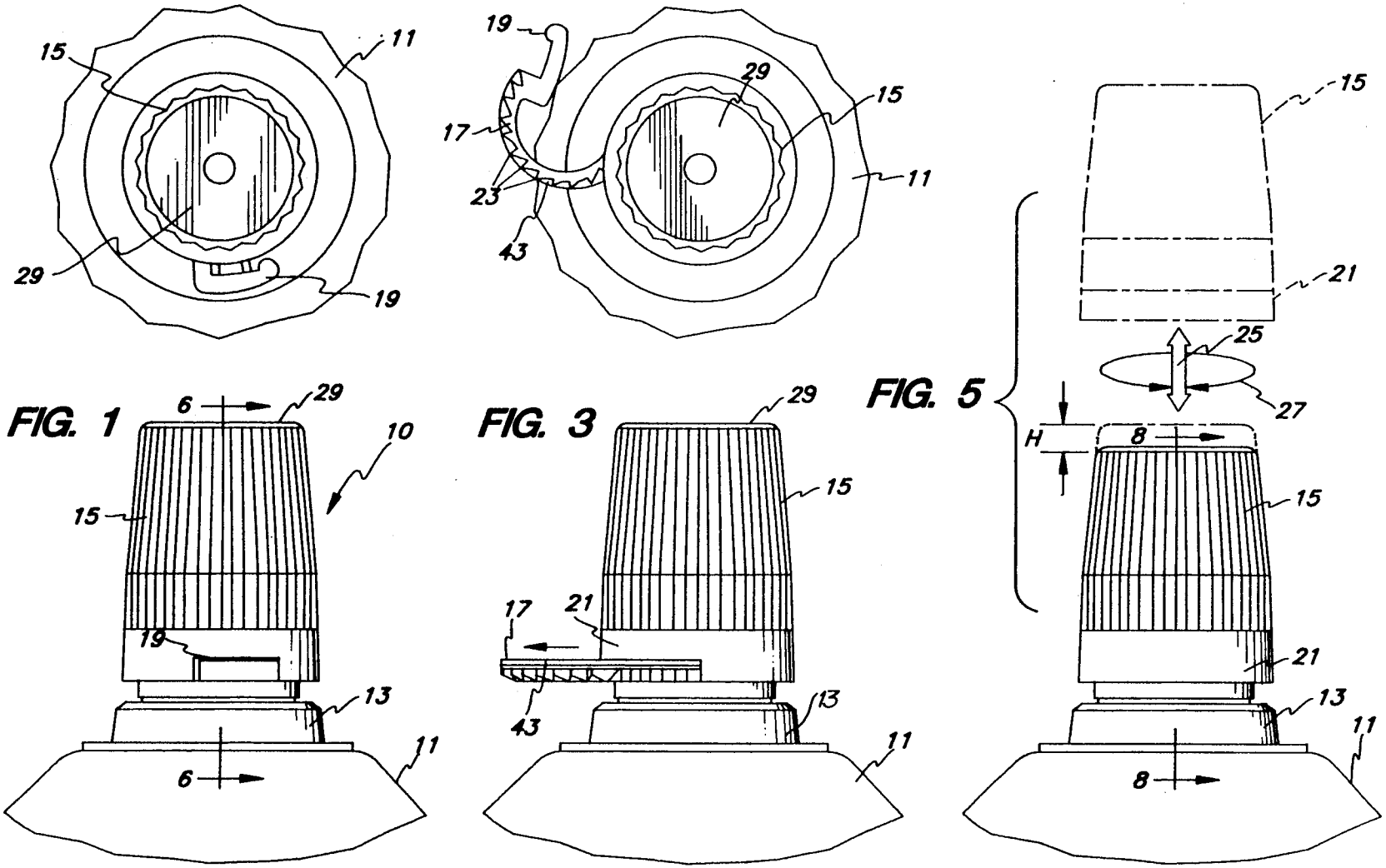
FIG. 1 is an enlarged fragmentary elevational view of a closure according to the present invention, prior to opening.
FIG. 2 is a plan view of the device shown in FIG. 1.
FIG. 3 is a view similar to FIG. 1, but with the tear band of the closure member in a partially opened or activated condition.
FIG. 4 is a plan view of the device shown in FIG. 3.
FIG. 5 is a view similar to FIG. 1 showing the cap sealed on the closure without the tear band, with the removed cap shown in dot and dash lines.

As can be seen from FIGS. 1 and 5, the tamper evident feature of the device, shown generally by the reference numeral 10, provides for a certain appearance when the tamper evident band is in place, and provides for a similar or nearly identical appearance of the product when the tamper evident band has been removed. As will be shown hereinafter, product safety is maintained in both cases.

For purposes of illustration, the present invention is shown in combination with a tube 11 which contains a product such as toothpaste which necessitates frequent removal and replacement of a cap. It is, of course, clear that the present invention can be applied to any container other than a tube 11, without departing from the spirit of the invention.

Most generally, the present invention is intended to be used with containers such as tubes 11 which are filled and sealed at one end, not shown, and which have a second terminal end 13 onto which an overcap 15 is placed.

The overcap 15 is attached to the terminal end 13 by a tear band 17 which can be removed by pulling on handle 19, leaving a permanent band 21 as part of overcap 15. When the cap 15 is removed and replaced, in the direction of up and down arrow 25, such as by rotation about the axis as shown in arrow of rotation 27, the cap can be replaced on terminal end 13 to give a substantial identical appearance to the assembly prior to removal of the tear band 17. This feature, that the cap and tube assembly appear the same before and after removal of the tamper evident band, is an aesthetic advantage which provides an incentive to purchasers of the product for consumption in the home. Permanent band 21 fits adjacent the terminal end 13 after removal of the tamper evident band 17, and the overall height of the product is decreased by a distance H, which corresponds approximately exactly to the width of the tamper evident band 17.

As can be noted in FIGS. 3 and 4, the tamper evident band 17 includes a plurality of sawteeth 23 whose function is to prohibit removal of the overcap 15 by preventing rotation of the overcap in the removal direction while facilitating rotation of the cap onto the tube end 13.

Figure 6:
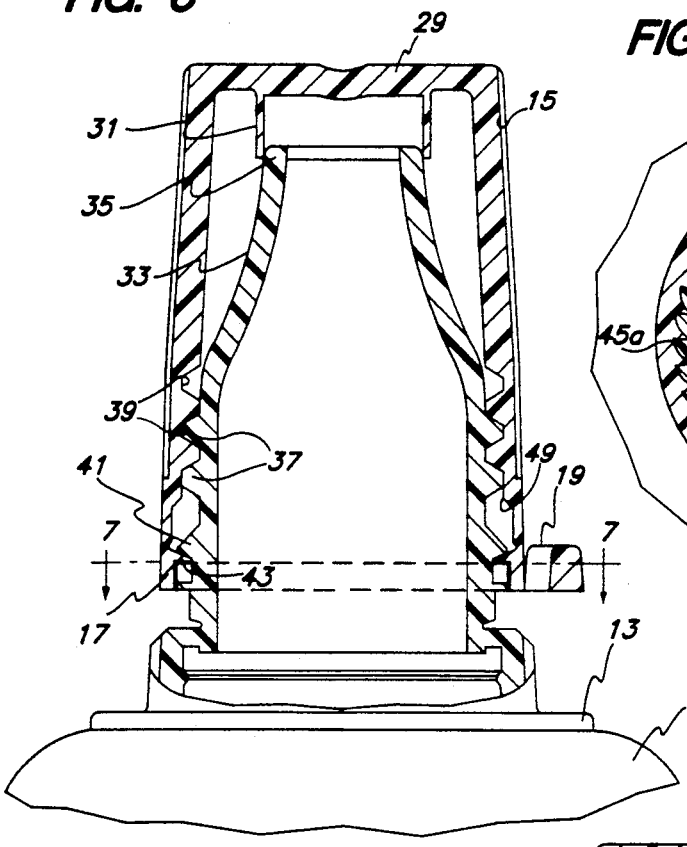
FIG. 6 is a sectional view taken along the line 6—6 of FIG. 1.
Figure 7:
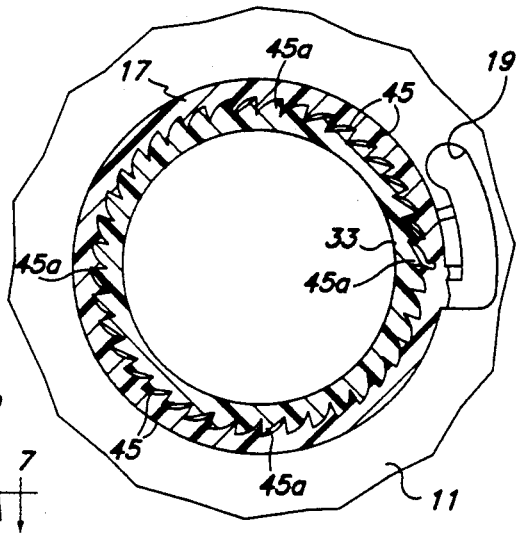
FIG. 7 is a sectioned plan view taken along line 7—7 of FIG. 6.
Figure 8:
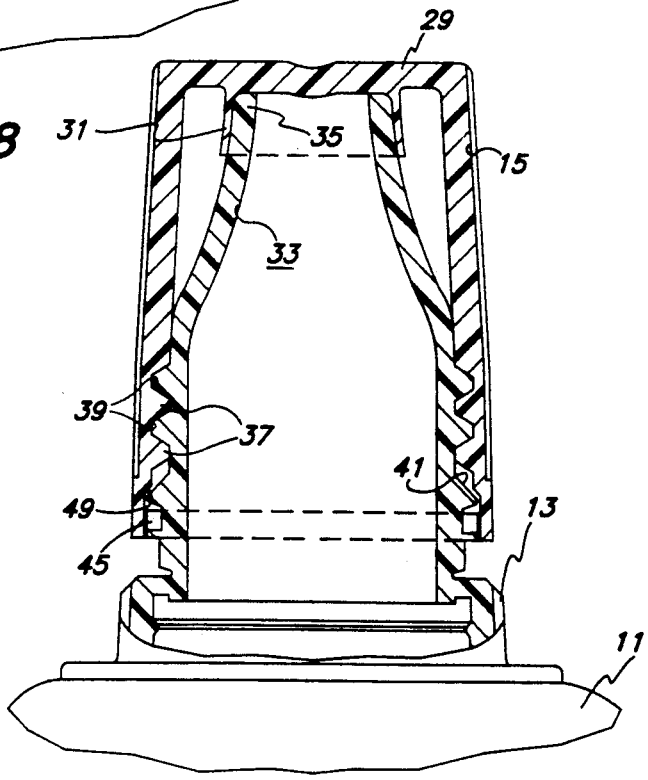
FIG. 8 is a view similar to FIG. 6, only taken along line 8—8 of FIG. 5.
Figure 9:
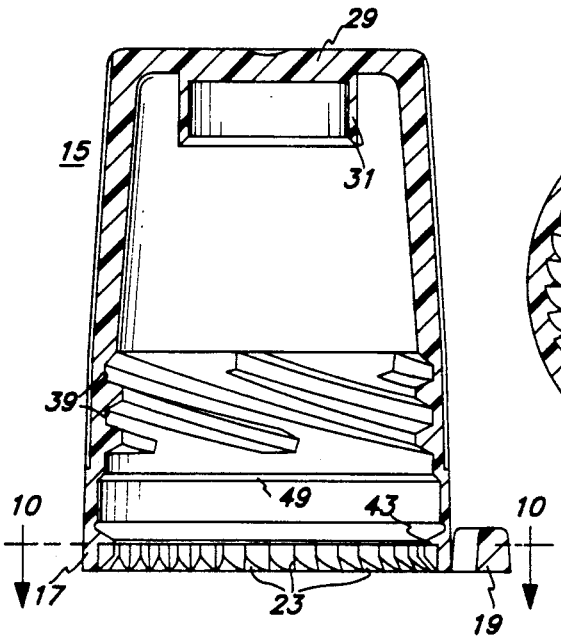
FIG. 9 is an enlarged sectional elevational view of a cap according to the present invention.
Figure 10:
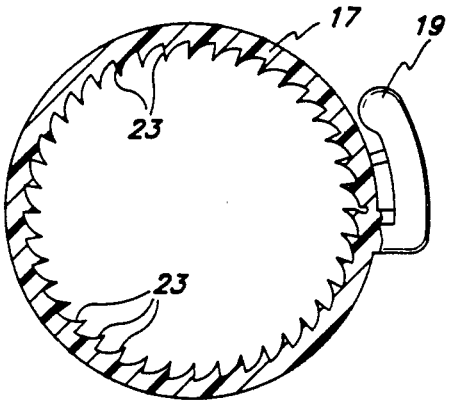
FIG. 10 is a view taken along line 10—10 of FIG. 9.

Turning now to FIGS. 6, 7, and 8, the internal structure of the device shown previously is more clearly illustrated. Specifically, cap 15 has an upper terminal end 29 which is axially centered and which includes an axially centered locating cup 31. Locating cup 31 is made of flexible material so that the diameter of the cup can be expanded. The base of tube end 13 forms an upper end or nozzle 33 which tapers to a narrow nozzle tip 35. The nozzle 33 includes threads 37 which cooperate with double threaded grooves 39 which have been formed on the inside of cap 15. Thus, the cap 15 can be quickly tightened on nozzle 33 and, eventually, will permit easy removal and replacement of the cap 15 on the nozzle 33.

Also located on the nozzle is a ring 41 which extends radially outwardly from nozzle 31 to define a location along the axis of the nozzle 33. The tamper evident band 17 includes a flange 43 which limits the removal of cap 15 as long as band 17 remains on the cap. As can be seen, when the cap 15 is threaded onto the nozzle 33, flange 43 slides over the ring 41, which is suitably tapered to expand slightly the diameter of the band 17 at flange 43. Once the flange 43 has passed by the ring 41, the sharper angle of ring 41 and the surface of flange 43 cooperate to prevent removal of the cap 15 from the nozzle 33.

As shown in FIG. 7, the tube nozzle 33 includes a plurality of teeth 45 which engage teeth 23 on band 17 over two 90° arcs around the periphery of nozzle 33. Two equally sized smooth arcs 47 are provided for reasons which will be explained below. As is noted, the teeth 23 and the teeth 45 are designed to permit relative movement with respect to each other when cap 15 is rotated in the direction of the common slopes of the teeth, which is designed to be the direction of rotation for placing the cap 15 on the tube nozzle 33. The teeth 23 and 45 cooperatively prevent rotation of the cap 15 with respect to the nozzle 33 in the opposition or removal direction. Thus, two separate devices are provided to lock the cap 15 on the tube 33 as long as tamper evident band 17 remains on the cap 15.

As can be seen in FIG. 8, the tamper evident band 17 has been removed by pulling the handle 19. As part of the formation of the flange 43, the cap wall is scored or cut thin enough to permit easy removal of band 17 by tearing the cap material as the handle 19 is firmly pulled. Once the band 17 has been removed, teeth 23 no longer inhibit removal of the cap 15, and clearly, flange 43 has also been removed to allow the cap to be removed even with the presence of ring 41.

After some of the contents of the tube 11 have been removed, such as the application of a quantity of toothpaste, the cap 15 can be replaced as shown in FIG. 8.

The threads and groove 37 and 39 cooperatively allow the cap 15 to be tightened onto the tube nozzle 33 so that the narrow nozzle tip 35 fits into the axially centered locating cup 31, and may even be inserted as far as the upper terminal end 29 of the cap 15. Thus, a better seal is provided after the product has begun to be consumed. Ridge 49 on the cap 15 cooperates with the annular ring 41 on nozzle 33 to locate the cap 15 in approximately the same position from an appearance standpoint, with respect to the terminal end 13 of the tube 11.

As can be seen, the tear band 17 holds the cap 15 on the original package and secures it thereto. After removal of the tear band 17, the cap 15 is designed to move an additional vertical height H in FIG. 5, which the tear band 17 occupied, and cap 15 will now completely seat the nozzle tip 35 on the cap end 29 in the axially centered locating cup 31. Appearance and aesthetics are maintained and the integrity of the seal of the cap on the nozzle tip is maintained in either position.

Turning now to FIGS. 9 through 12, cap 15 is shown separated from nozzle 33. Again, cap 15 includes a terminal end 29 which provides axially centered locating cup 31 which is made of flexible material. Similarly, tube end 13 supports a nozzle 33 which has a narrow nozzle tip 35. Threads 37 on nozzle 33 cooperate with double threaded grooves 39 on cap 15 so that cap 15 can be rotated on and off of the nozzle 33. A radially extending ring 41 is positioned to locate cap 15, both with and without tamper evident band 17. When band 17 is in position, flange 43, which is formed as the narrow scored portion defining band 17, prevents removal of the cap. The flange 43 is designed to be rotated over ring 41, but not in the reverse direction. When tamper evident band 17 has been removed, ring 41 contacts ridge 49 on band 15 when the cap has been rotated onto the nozzle 33 to the same degree as initially, to preserve appearances and aesthetics.

Figure 11:
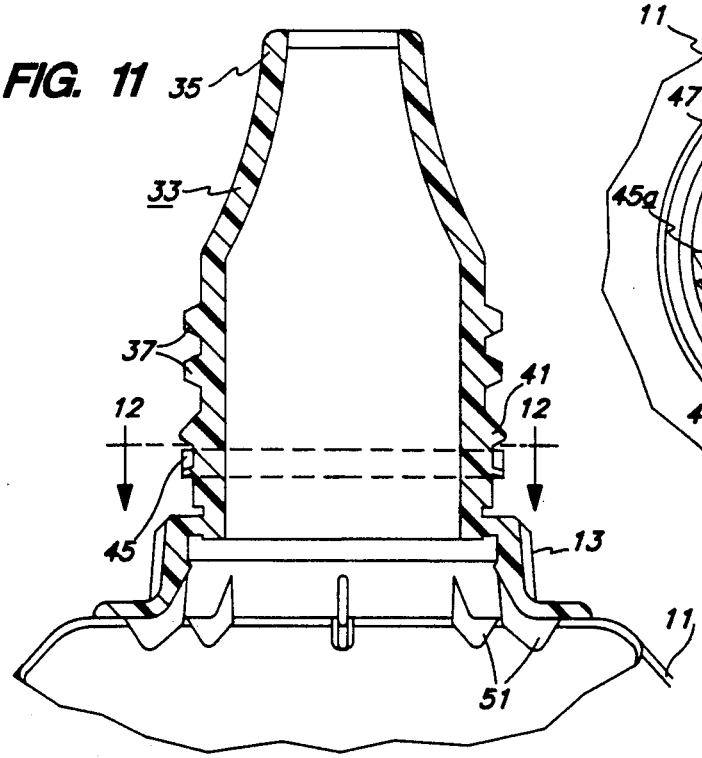
FIG. 11 is a fragmentary, sectional elevational view of the nozzle of the present invention.

In FIG. 11, it can be seen that tube 11 includes rigidifying ribs 51 which are provided to reenforce the strength of the junction between the tube 11 and the terminal end 13.

As previously noted, teeth 23 of tamper evident band 19 are step like, permitting rotation along the sloped surfaces while preventing rotation in the reverse direction due to the radially straight surfaces on teeth 23.

Figure 12:
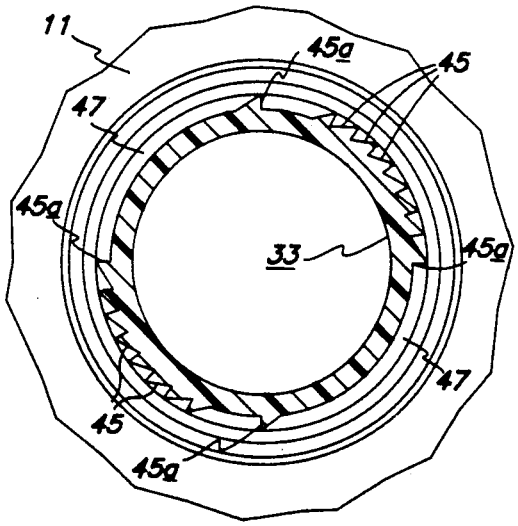
FIG. 12 is a view taken along line 12—12 of FIG. 11.

The nozzle teeth 45 which cooperate with teeth 23 of tear bands 17 are shown in FIG. 12. These teeth 45 are designed to interlock with band teeth 23 and are located by four centering teeth 45a which are positioned at 90° intervals from one another. The smooth portion 47 is provided to facilitate molding and assembly.

While particular embodiments of the present invention have been illustrated and described herein, it is not intended to limit the invention. Changes and modifications may be made therein within the scope of the following claims.

What is claimed is:

1. In combination, a cap and tube device, comprising:

a tube having an opening terminating in a tapered nozzle with an open end, said nozzle having a first diameter proximate said tube and having means for rotational engagement with a cap and having a ring defining the maximum diameter of said nozzle, said ring being located at least a band width distance from the junction of said nozzle to said tube; and a cap sized to engage said nozzle at its open end and having a closed terminal cap end, said terminal cap end including an inward facing axially centered locating cup for engagement with said open end of said nozzle to form a first seal in a first position and a second seal in a second position closer to said terminal cap end by said band width distance, said cap having means for cooperating with said means for rotational engagement, said cap terminating at its open end with a circumferential band having an axial width defining said band width distance, said band having a frangible junction with said cap to permit removal therefrom and a flange positioned to fit over said nozzle ring to fasten said cap to said nozzle, said cap further including ridge means for engagement with said ring upon removal of said band to locate said second position;

whereby removal of said band permits said cap to be removed or be moved to said second position.

2. The device of claim 1 wherein said threaded means includes double threaded grooves.

3. The device of claim 1 wherein said band includes a pull tab on one point on said band, providing means for removing said band.

4. The device of claim 1 wherein said tube nozzle fits inside said locating cup at said first position and said tube nozzle is flush against said tube end at said second position.

5. The device of claim 1 wherein said circumferential band includes a plurality of radially inwardly extending ratchet means and said nozzle includes ratchet engaging means for engagement with said ratchet means upon rotation of said cap onto said nozzle, said ratchet and ratchet engaging means preventing rotation of said cap off of said nozzle without removal of said band.

6. In combination, a cap and tube device, comprising:

a tube having an opening terminating in a tapered nozzle with an open end, said nozzle having a first diameter proximate said tube and having means for rotational engagement with a cap and having a ring defining the maximum diameter of said nozzle, said ring being located at least a band width distance from the junction of said nozzle to said tube; and a cap sized to engage said nozzle at its open end and having a closed terminal cap end, said terminal cap end including an axially centered locating cup for engagement with said open end of said nozzle to form a first seal in a first position and a second seal in a second position closer to said terminal cap end by said band width distance, said cap having means for cooperating with said means for rotational engagement, said cap terminating at its open end with a circumferential band having an axial width defining said band width distance, said band having a frangible junction with said cap to permit removal therefrom and a flange positioned to fit over said nozzle ring to fasten said cap to said nozzle, said cap further including ridge means for engagement with said ring upon removal of said band to locate said second position;

said circumferential band includes a plurality of radially inwardly extending ratchet means and said nozzle includes ratchet engaging means for engagement with said ratchet means upon rotation of said cap onto said nozzle, said ratchet and ratchet engaging means preventing rotation of said cap off of said nozzle without removal of said band;

whereby removal of said band permits said cap to be removed or moved to said second position.

7. The device of claim 6 wherein said threaded means includes double threaded grooves.

8. The device of claim 6 wherein said band includes a pull tab on one point of said band, providing means for removing said band.

9. The device of claim 6 wherein said tube nozzle fits inside said locating cup at said first position and said tube nozzle is flush against said tube end at said second position.

* * * * *